US011669123B2

(12) United States Patent
Erkocak

(10) Patent No.: US 11,669,123 B2
(45) Date of Patent: Jun. 6, 2023

(54) JOYSTICK MOVABLE IN MULTI-AXES WITH ENHANCED SECURITY

(71) Applicant: MAKERSAN MAKINA OTOMOTIV SANAYI TICARET ANONIM SIRKETI, Kocaeli (TR)

(72) Inventor: Levent Erkocak, Kocaeli (TR)

(73) Assignee: MAKERSAN MAKINA OTOMOTIV SANAYI TICARET ANONIM SIRKETI, Kocaeli (TR)

( * ) Notice: Subject to any disclaimer, the term of this patent is extended or adjusted under 35 U.S.C. 154(b) by 89 days.

(21) Appl. No.: 17/422,190

(22) PCT Filed: Jan. 10, 2019

(86) PCT No.: PCT/TR2019/050024
§ 371 (c)(1),
(2) Date: Jul. 10, 2021

(87) PCT Pub. No.: WO2020/145910
PCT Pub. Date: Jul. 16, 2020

(65) Prior Publication Data

US 2022/0083092 A1 Mar. 17, 2022

(51) Int. Cl.
*G05G 9/047* (2006.01)

(52) U.S. Cl.
CPC ..... *G05G 9/04792* (2013.01); *G05G 2009/04755* (2013.01); *G05G 2009/04766* (2013.01); *G05G 2009/04774* (2013.01)

(58) Field of Classification Search
CPC ..... G05G 2009/04774; G05G 2009/04755; G05G 2009/04766; G05G 2009/04748; G05G 2009/04781; G05G 2009/04792
See application file for complete search history.

(56) References Cited

U.S. PATENT DOCUMENTS

| | | | | |
|---|---|---|---|---|
| 6,359,614 | B1 * | 3/2002 | McVicar | G05G 1/06 345/157 |
| 6,755,195 | B1 * | 6/2004 | Lemke | A61B 46/10 128/853 |
| 8,089,459 | B2 * | 1/2012 | Passaro | G06F 3/0338 345/161 |
| 2006/0028184 | A1 * | 2/2006 | Lewis | G05G 9/047 322/3 |

(Continued)

*Primary Examiner* — Daniel D Yabut
(74) *Attorney, Agent, or Firm* — Bayramoglu Law Offices LLC

(57) ABSTRACT

A joystick for controlling a machine in multi-axes includes: a handle assembly allowed to rotate around a central axis extending along a longitudinal direction of the joystick, comprising a button body in which an upper circuit board having an upper sensor is provided; a control assembly having a lower body in which a lower circuit with an lower sensor is provided; and a control lever partly introduced to the handle assembly and mounted on a pivotal member for pivotal movement relative to the lower body. The control lever is at least partly made of plastic in an injection-molding operation and has an overmolded lower magnet provided in the proximity of the lower circuit of the a control portion, wherein the control lever has a further upper magnet provided in the proximity of the upper circuit of the handle assembly.

19 Claims, 16 Drawing Sheets

(56) References Cited

U.S. PATENT DOCUMENTS

| | | | | |
|---|---|---|---|---|
| 2007/0040803 | A1* | 2/2007 | Dider | G05G 9/047<br>345/161 |
| 2012/0025809 | A1* | 2/2012 | Banerjee | G05G 7/02<br>324/207.13 |
| 2012/0152719 | A1* | 6/2012 | Schulein | G05G 5/05<br>200/6 R |

* cited by examiner

JOYSTICK MOVABLE IN MULTI-AXES WITH ENHANCED SECURITY

CROSS REFERENCE TO THE RELATED APPLICATIONS

This application is the national phase entry of International Application No. PCT/TR2019/050024, filed on Jan. 10, 2019, the entire contents of which are incorporated herein by reference.

TECHNICAL FIELD

The present invention relates to a joystick movable in multi-axes and more particularly relates to a joystick with an increased precision allow to be used in three-axes.

BACKGROUND

In the art, joysticks are often used in a wide variety of motion control applications in order to control movement in a number of axes. A control lever or control arm of such joystick is mainly made of metal or the like materials, however manufacturing and applying any mechanical process on said control levers are difficult and requires excessive labor works. When producing such control levers of the joysticks, at least cutting, drilling, polishing and deburring processes have to be applied on said control levers. Further, such control lever arms are used with at least one magnet which has to be firmly attached thereon. In the art, such magnets are attached to the control lever by way of glue or any other bonding material. However, it is difficult to attach the magnet to the control lever and requires additional operations.

Further, joysticks are commonly used with a helical spring attached on the control lever. If such spring does no longer works, then security problems occur since false signal is continuously sent.

Among others, one of the prior art disclosures in the technical field of the present invention can be referred to as EP1 808 738 A1, which defines a joystick controller comprises an operating shaft mounted for pivotal movement relative to a housing. The joystick controller is configured such that when the operating shalt is in a null position a release of pressure applied on the operating shaft is effective to lock the joystick so as to prevent further pivotal movement. The document discloses that the control lever is used with single spring.

SUMMARY

The present invention relates to a joystick for controlling a machine, comprising: a handle assembly allowed to rotate around a central axis extending along a longitudinal direction of the joystick, comprising a button body in which an upper circuit board having an upper sensor is provided; a control assembly having a lower body in which a lower circuit with an lower sensor is provided; and a control lever partly introduced to the handle assembly and mounted on a pivotal member for pivotal movement relative to the lower body characterized in that said control lever is at least partly made of plastic in an injection-molding operation and has an overmolded lower magnet provided in the proximity of the lower circuit of the a control assembly, wherein the control lever has a further upper magnet provided in the proximity of the upper circuit of the handle assembly. Thus, a compact, reliable and precise control lever can be provided. Further, use of single printed circuit board is sufficient. Further, by using plastic material, any type of corrosion and rustiness is eliminated.

In a possible embodiment, the control lever comprises a separate upper lever part having the upper magnet formed as an extension of the control lever in the handle assembly. Thus, joystick controller which is capable of being produced in a cost-effective manner and which can be easily assembled with high sensitivity.

In a possible embodiment, the handle assembly has a locking member having at least one connection protrusion arranged to match with a corresponding housing of the upper lever part wherein the locking member is attached to the control lever.

In a possible embodiment, the upper lever part is placed within an upper magnet housing facing the upper circuit of the handle assembly.

In a possible embodiment, the injection molded control lever has a lower pinhole through which a lower pin is arranged to pass for attaching the control lever to the pivotal member, and an upper pin hole through which an upper pin is arranged to pass for attaching the locking member to the control lever.

In a possible embodiment, the button body has at least one button hole and the each button hole is provided with a button and a button spring associated with a button switch provided on the upper circuit, wherein the each button and the button switch have a sealing member provided therebetween to provide sealing thereof. Thus, the undesired positioning of the springs and maloperation is prevented.

In a possible embodiment, the joystick comprises a friction plate attached to the inner volume of the lower body to be on the pivotal member and a friction member provided on said friction plate into which said control lever passes.

In a possible embodiment, the joystick comprises a cap having connection holes through which an intermediate pin passes via a medium pin hole for attaching the cap thereof.

In a possible embodiment, the joystick comprises a first spring and a second spring having different diameters with respect to each other, said first and second springs provided between the cap and the friction member.

In a possible embodiment, the friction member has a first guiding portion in which the first spring is arranged and a second guiding portion in which the second spring is arranged.

In a possible embodiment, the button body is at least partly filled with an epoxy-resin composition for sealing thereof.

In a possible embodiment, the upper circuit board is provided with at least one lightning member and the button body is at least partly translucent or transparent.

In a possible embodiment, the said control lever is made of plastic in an injection-molding operation and has a completely embedded overmolded lower magnet.

In a possible embodiment, the separate upper lever part is made of plastic in an injection-molding operation and has a completely embedded overmolded upper magnet.

In a possible embodiment, the each lower circuit and upper circuit has two lower sensors and upper sensors, respectively. Each sensors is configured to sense the displacement of the lower magnet and the upper magnet wherein the each lower sensor and the upper sensor are Hall-effect sensor.

BRIEF DESCRIPTION OF THE DRAWINGS

The figures of the subject matter joystick, whose brief explanations are herewith provided, are solely intended for providing a better understanding of the present invention and are as such not intended to define the scope of protection or the context in which said scope is to be interpreted in the absence of the description.

DETAILED DESCRIPTION OF THE EMBODIMENTS

Figure 1:
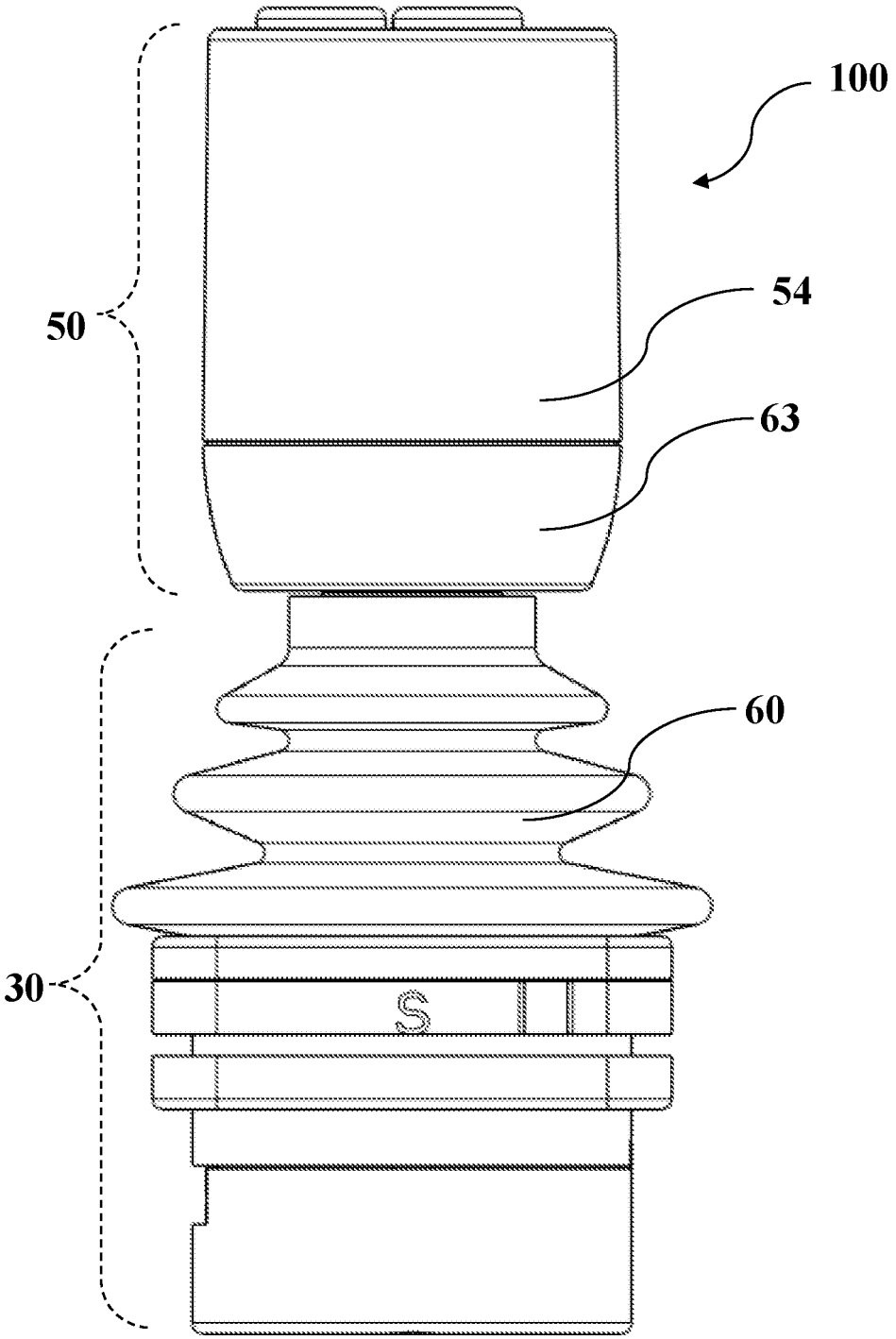
FIG. 1 is a perspective of the joystick according to the present invention.
Figure 2A:
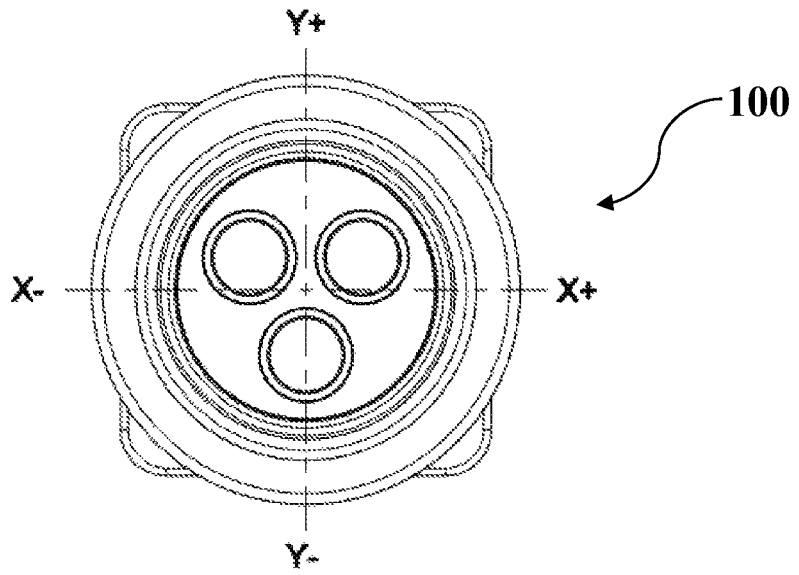
FIG. 2A is an upper perspective of the joystick indicating X and Y axes according to the present invention.
Figure 2B:
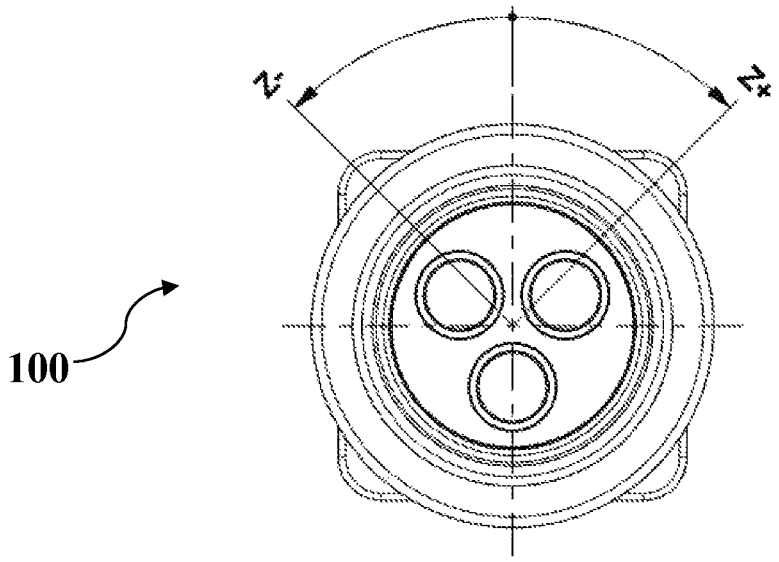
FIG. 2B is an upper view of the joystick indicating the Z axis according to the present invention.

The invention will now be described in detail with reference to the accompanying drawings, wherein reference numerals assigned to the parts therein are listed as follows;

20. Lower magnet
30. Control assembly
31. Cap
32. First spring
33. Intermediate pin
34. Second spring
35. Friction member
36. Friction plate
37. Retention plate
38. Lower pin
39. Pivotal member pin
40. Pivotal member
41. Lower body
42. Fastening member
43. Guiding channel
44. Lower circuit
45. Skirt
47. Lower sensor
48. Lower cover
50. Handle assembly
51. Button plate
52. Connection protrusion
54. Upper body
55. Fixing ring
57. Locking member
58. Upper pin
59. Spring element
60. Flexible boot
61. Spring arm
63. Spring house
70. Button body
71. Button spring
72. Button
73. Button sealing member
74 Upper circuit
75. Upper magnet housing
77. Locking ring
78. Button switch
79. Upper sensor
80. Control lever
81. Upper pin hole
82. Friction surface
83. Middle pin hole
84. Lower pin hole
86. Passage
87. Upper magnet
90. Upper lever part
91. First guiding portion
92. Second guiding portion
93. Epoxy based-composite
110. Attachment plate
120. Attachment member The present invention proposes a joystick (100) utilizing a non-contact principle for sensing joystick position, for example utilizing a Hall or other magnetic proximity effect. The present invention mainly proposes a joystick (100) for controlling a machine in multi-axes (X, Y and Z), comprising: a handle assembly (50) allowed to rotate around a central axis extending along a longitudinal direction of the joystick (100), comprising a button body (70) in which an upper circuit board (74) having an upper sensor (79) is provided; a control assembly (30) having a lower body (41) in which a lower circuit (44) with an lower sensor (47) is provided; and a control lever (80) partly introduced to the handle assembly (50) and mounted on a pivotal member (40) for pivotal movement relative to the lower body (41). Said control lever (80) is at least partly made of plastic in an injection-molding operation and has an overmolded lower magnet (20) provided in the proximity of the lower circuit (44) of the control assembly (30). Advantageously, the control lever (80) has a further upper magnet (87) provided in the proximity of the upper circuit (74) of the handle assembly (50). Referring to the FIG. 2A, the control lever (80) can be moved pivotally mounted on a first axis Y-Y, and an orthogonal to the first axis X-X. The first axis X-X and the second axis Y-Y cross at the pivot center of the pivotal member (40).

In a preferred embodiment, the joystick (100) is configured for pivotal movement in two directions (X and Y) and for rotational movement in one rotational direction (Z). The said control lever (80) is preferably made of plastic in an injection-molding operation and has a completely embedded overmolded lower magnet (20). When the control lever (80) is moved so as to pivot about a pivot center defined by the center of the pivotal member (40), the control lever (80) bears against a retention plate (37). The control lever (80) can be provided with at least two magnets oriented at the different ends of the control lever (80). In one embodiment of the present invention, said control lever (80) can be formed as a single unit with at least two magnets (upper and lower magnets) provided at the opposite ends. Using such upper magnet (87) on the upper lever part (90) as a separate unit helps easy assembly of the joystick (100).

Figure 6:
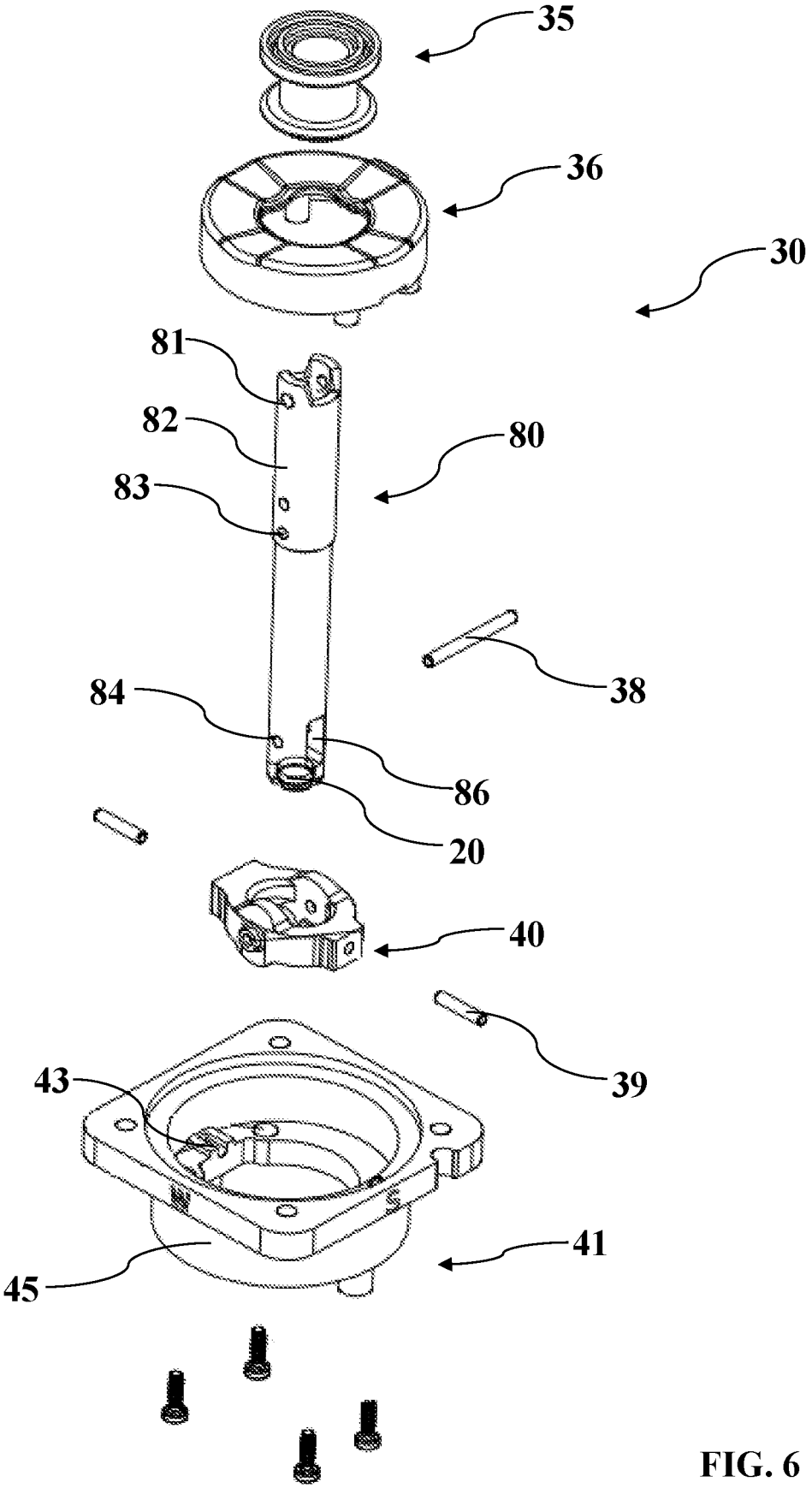
FIG. 6 is another exploded view of the control assembly of the joystick according to the present invention.
Figure 9A:
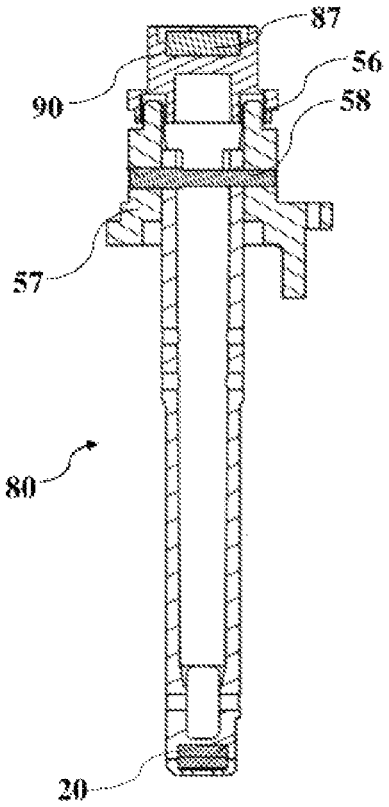
FIG. 9A is a longitudinal cross-sectional view of the control lever attached to the upper lever part according to the present invention.
Figure 9B:
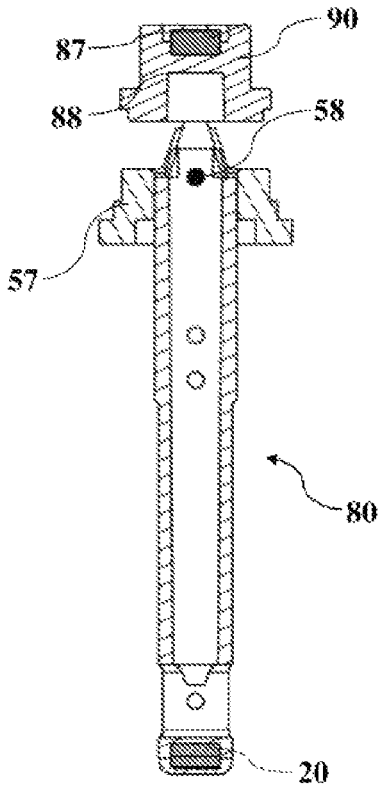
FIG. 9B is another longitudinal cross-sectional view of the control lever attached to the upper lever part with a locking member according to the present invention.

Referring to the FIGS. 6, 9A, and 9B, said control lever (80) is produced by an injection molding process by having holes and apertures and a magnet to be embedded inside. In the injection molding process of the control lever (80), a magnet, preferably the lower magnet (20) is placed into the injection mold and the control lever (80) is produced as a whole with the embedded lower magnet (20) inside. As shown in FIGS. 9A and 9B, said lower magnet (20) can be provided at one end of the control lever (80) facing to the lower circuit (44) of the control assembly (30). This production step of the control lever (80) minimizes production expenses of a control which is made from metal and allows the lower magnet (20) to be safely kept in the control lever (80). Further, dislocation or drooping of the lower magnet (20) from the control lever (80) is also prevented which in results a more secure joystick (100) is achieved.

The lower sensor (47) and the upper sensor (79) can be Hall-effect sensors arranged to vary their output voltage in response to a magnetic field. Accordingly, the lower magnet (20) and the upper magnet (87) are arranged to be in communication with the upper circuit (74) and the lower circuit (44), respectively. In one embodiment, the lower circuit (44) has two lower sensors (47), each lower sensor (47) configured to sense the displacement of the lower magnet (20) wherein each of the lower sensor (47) and the upper sensor (79) is a Hall-effect sensor.

In a preferred embodiment, the control lever (80) has a separate upper lever part (90) having the upper magnet (87) inside and formed as an extension of the control lever (80) by extending to the handle assembly (50). Said upper lever part (90) can also be produced by an injection molding process where the upper magnet (87) is placed into an injection mold first and then injection molding is completed. By having a separate magnet inside, more compact system can be obtained, and the assembly of the control assembly (30) and the handle assembly (50) can be simplified.

Figure 8:
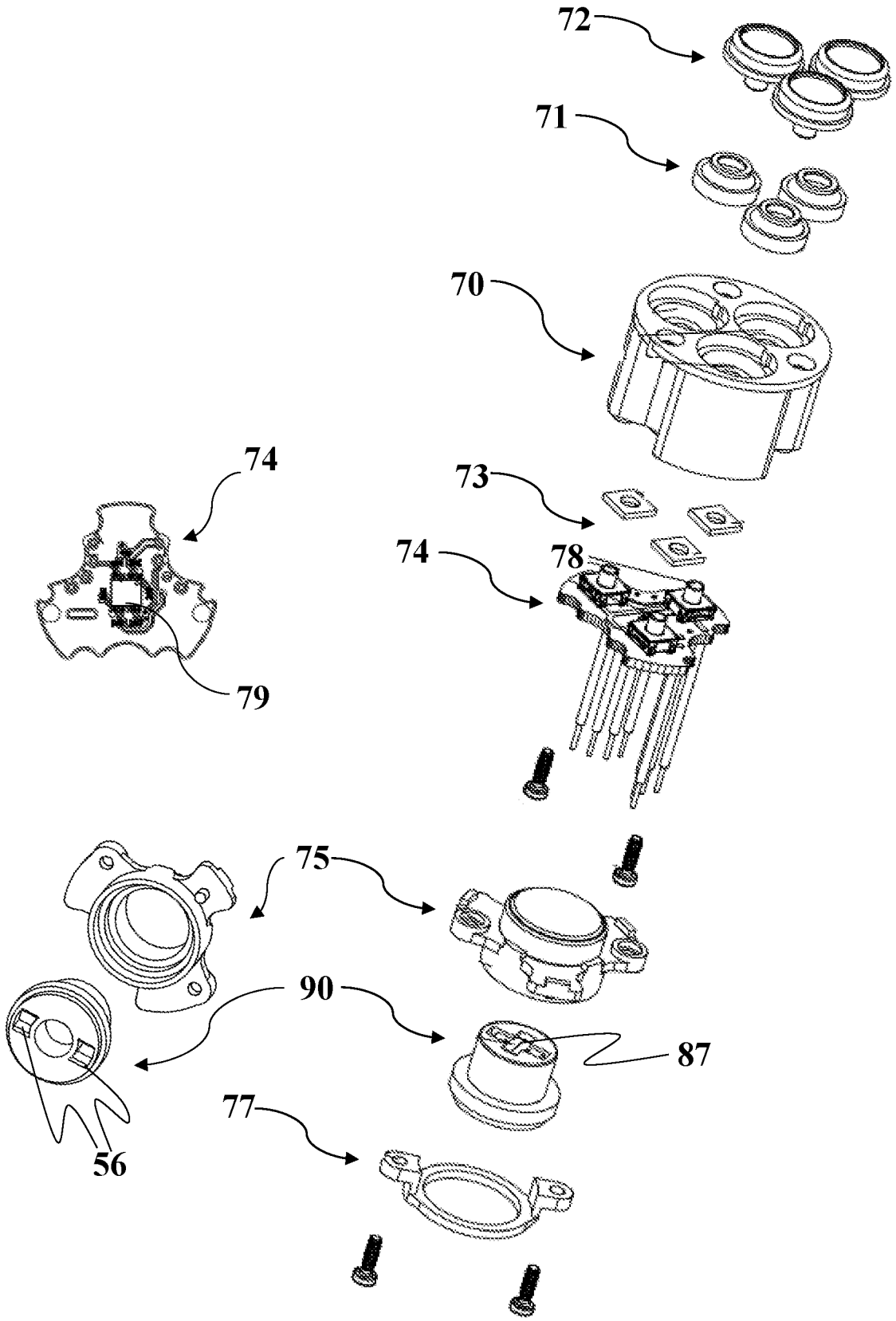
FIG. 8 is an exploded perspective view of a handle assembly of the joystick where an upper circuit and an upper lever part are shown according to the present invention.

A locking member (57) having at least one connection protrusion (52) arranged to match with a corresponding housing of the upper lever part (90) wherein the locking member (57) is attached to the control lever (80). Referring to the FIG. 8, the upper lever part (90) can have two grooves (56) shaped and dimensioned to match with corresponding connection protrusions (52) of the locking member (57). Said grooves is mainly provided at the bottom of the upper lever part (90) and the number of the grooves (56) can be increased or decreased. In another embodiment of the invention, said locking member (57) can be bonded or glued to the upper control lever (80) and in another embodiment, said locking member (57) can be omitted and only the control lever (80) can have same protrusions (52) as in the locking member (57) or the upper control lever (80) can be attached to the control lever (80) by gluing or bonding.

Figure 9C:
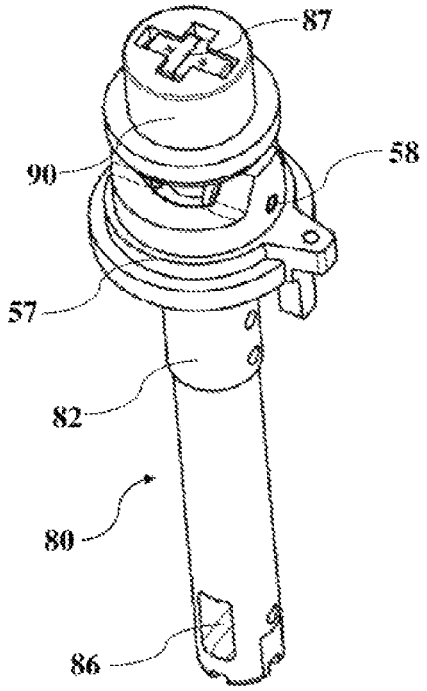
FIG. 9C is a perspective view of the control lever attached to the upper lever part with a locking member according to the present invention.

In a preferred embodiment, said locking member (57) has two extending elongated connection protrusions (52) arranged to keep the upper lever part (90) in an upright position. The locking member (57) has a hollow body into which one end of the control lever (80) is introduced and aligned to match with an upper pin hole (81) of the control lever (80). When the locking member (57) is aligned with the upper pin hole (81) of the control lever (80), an upper pin (58) is used to connect said locking member (57) to the control lever (80) and the upper lever part (90) is arranged on the locking member (57) as shown in FIGS. 9A-9C. Referring to the FIG. 8, The upper lever part (90) is placed within an upper magnet housing (75) facing to the upper circuit (74) of the handle assembly (50) such that said upper lever part (90) can be positioned centrically within the handle assembly (50) and the upper magnet (87) in the upper lever part (90) is kept safely. Said upper magnet housing (75) has at least one groove and protrusion to be attached within the handle assembly (30). The upper lever part (90) can have an outwardly extended rim which abuts against an inner housing of the upper magnet housing (75) when the upper lever part (90) is placed in the upper magnet housing (75).

The handle assembly (50) has a substantially cylindrical shaped upper rotary body (54) which is arranged to rotate around a central axis extending along a longitudinal direction of the joystick (100). Said upper rotary body (54) is placed on a lower handle housing (63) having a central hole portion into which the control lever (80) in a longitudinal direction. Said lower handle housing (63) can have a spring abutment portion (62) as an elongated protrusion arranged to be biased by spring arms (61) of a spring element (59) located in the lower handle housing (63). The spring element (59) may be a coil spring acting as a torsion spring or pressure spring. In another embodiment, said handle housing (63) can be eliminated, said upper rotary member (54) can have a skirt portion which covers bottom portion of the handle housing (63). The handle assembly (50) has a button body (70) which is encapsulated by the upper rotary body (54) of the handle assembly (50). The upper body can be rotated relative to the control assembly (30) is provided. The upper rotary member (54) can rotate to adjust the machine (i.e., making a zoom, or adjust the speed). And an arrow may be drawn at the top of the upper rotary member (54) to indicate the operating direction of the upper rotary member (54).

Figure 5:
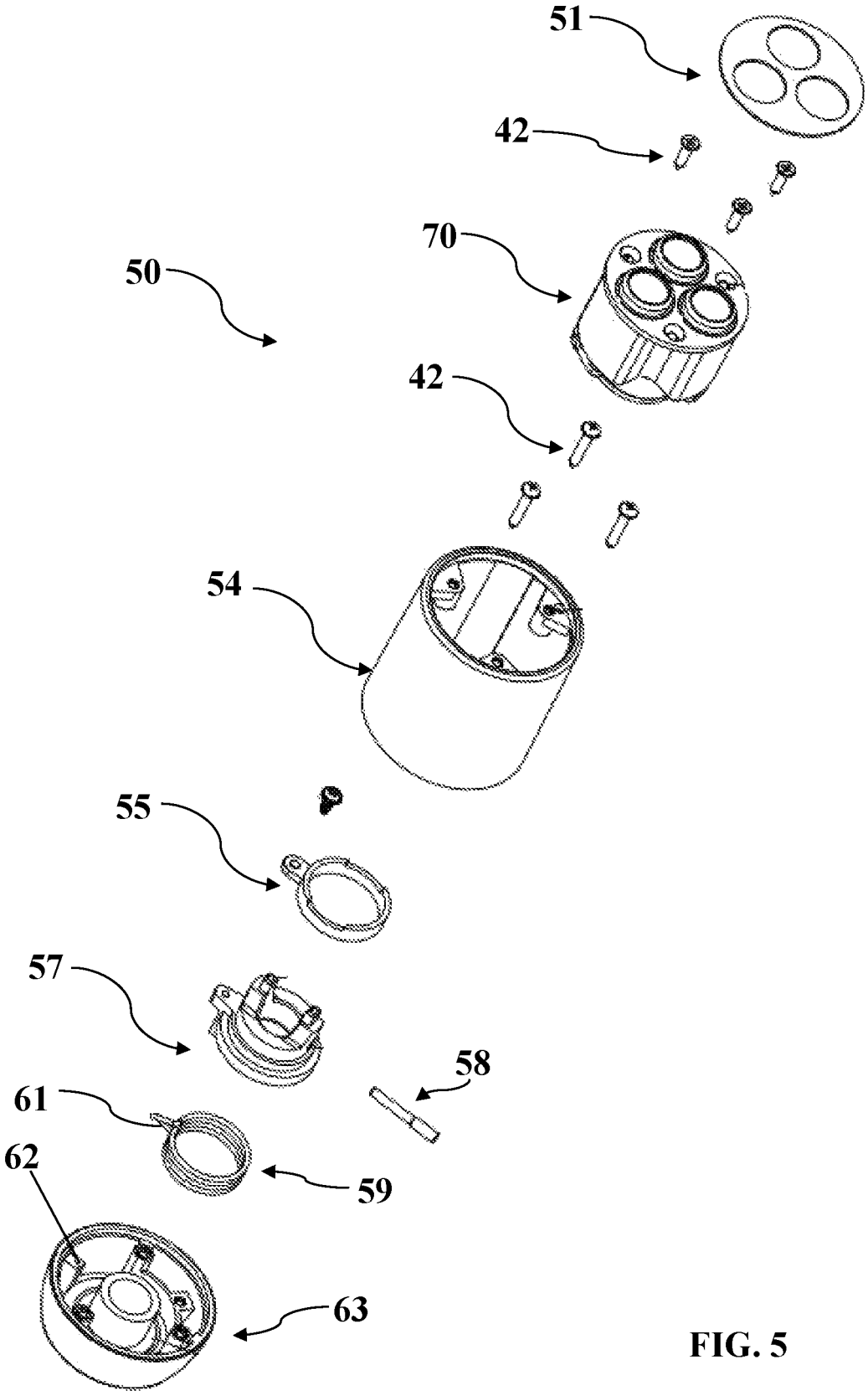
FIG. 5 is an exploded perspective view of a handle assembly of the joystick according to the present invention.
Figure 10A:
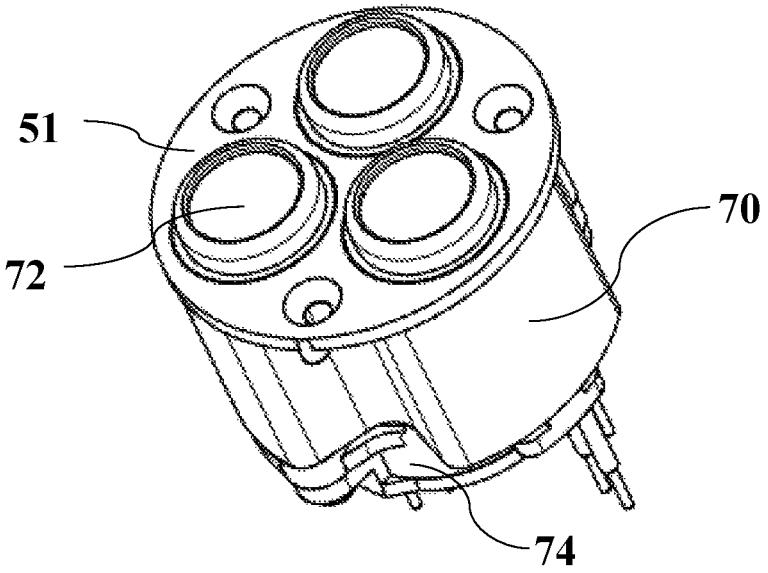
FIG. 10A is a perspective view of the handle assembly according to the present invention.
Figure 10B:
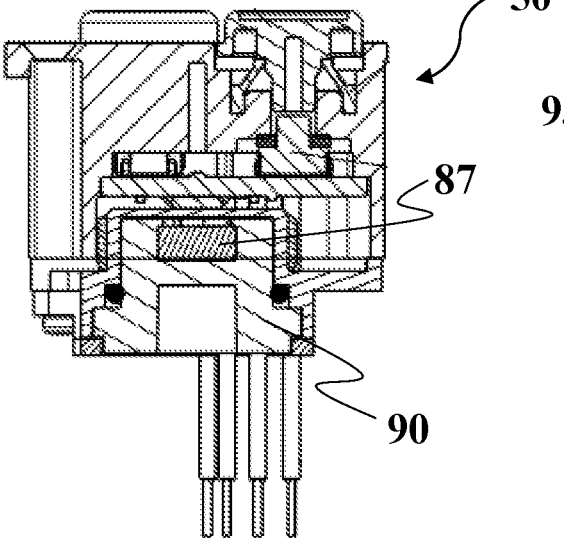
FIG. 10B is a longitudinal cross-sectional view of the handle assembly showing the magnet of the upper lever part according to the present invention.
Figure 10C:
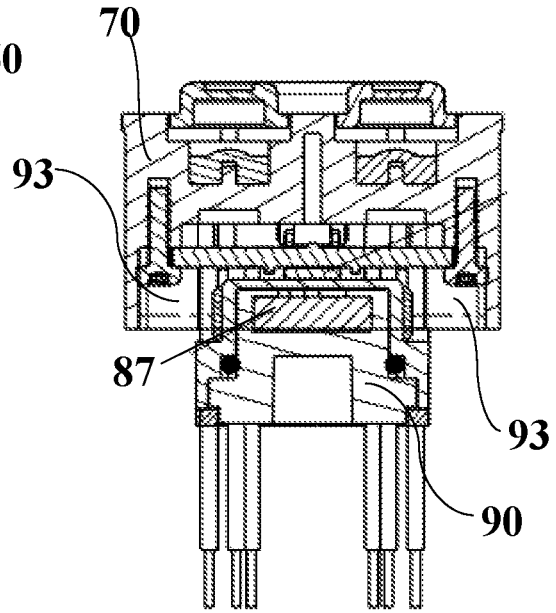
FIG. 10C is another longitudinal cross-sectional view of the handle assembly showing the upper magnet of the upper lever part according to the present invention.
Figure 11:
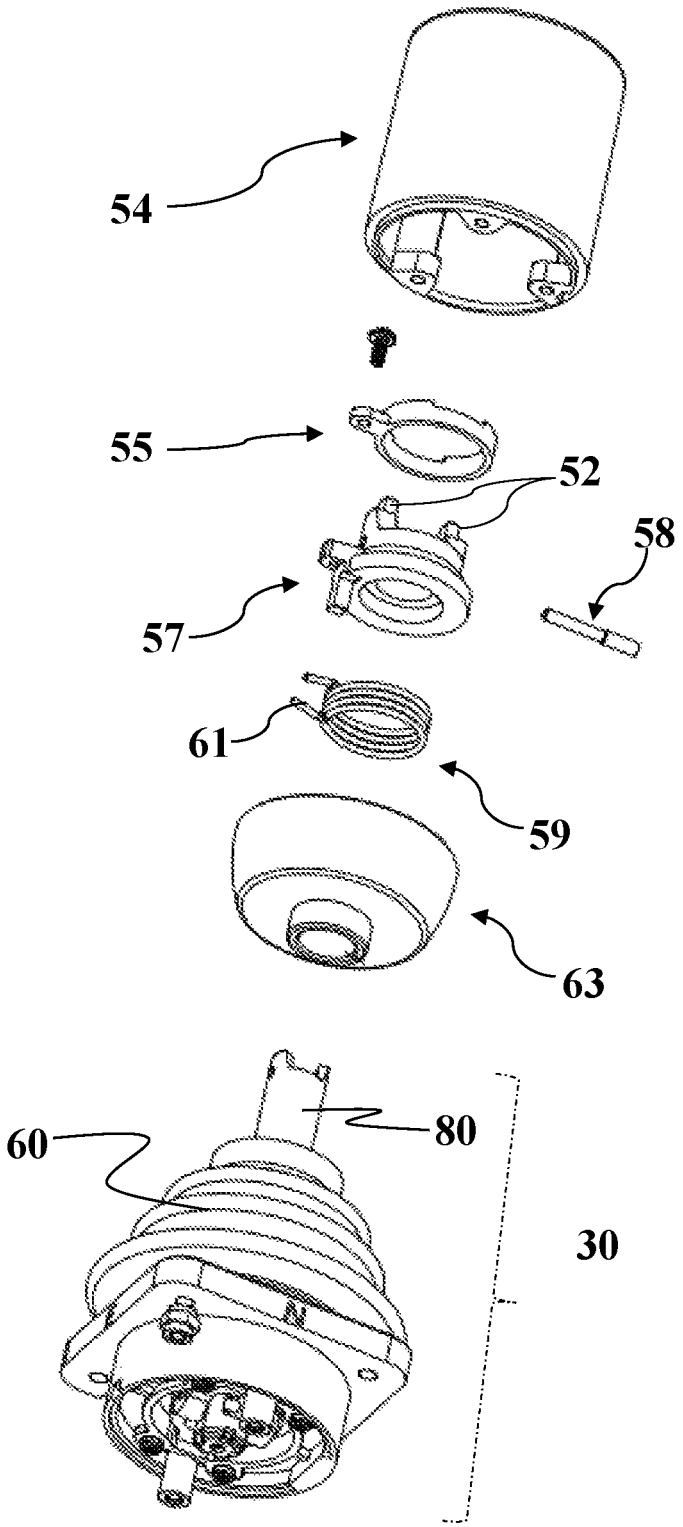
FIG. 11 is a partial perspective view of the control assembly and an exploded view of the handle assembly according to the present invention.

Referring to the FIG. 5, the button body (70), as a core portion, has at least one button hole and the each button hole is provided with a button (72) and a button spring (71), made from a resiliently deformable material for providing tactile effect, associated with a button switch (78) provided on the upper circuit (74). Referring to the FIG. 8, each button (72) and the button switch (78) have a sealing member (73) provided therebetween to provide sealing thereof. The sealing member (73) has a cross-section one of a circular shape, a square shape, elliptical shape or any other polygonal shape. Said button spring is placed within the corresponding button hole of the button body (70) and related buttons (72) are associated with said button springs (71). Preferably, the button body (70) is provided with a button plate (51) placed on the button body (70) after a plurality of fastening members is attached to the button body (70). Said button plate (51) is, preferably, opaque and has cylindrical apertures for matching with the buttons (72). With this arrangement, it is provided that the buttons (72) to be lightened. After the upper circuit (74) is placed its housing, the interior volume of the button body (70) can be filled, at least partly, with an epoxy-based composite (93) (shown in FIG. 10*c*) wherein said epoxy resin-based composite (93) commonly exhibits excellent strength, toughness, corrosion, moisture and solvent resistance. With this arrangement, completely fluid tightness in the handle assembly (50) is achieved. Said locking member (57) can be used with a fixing ring (55) which has a connection hole on an outwardly extending protrusion for attaching to the locking member (57).

Figure 3A:
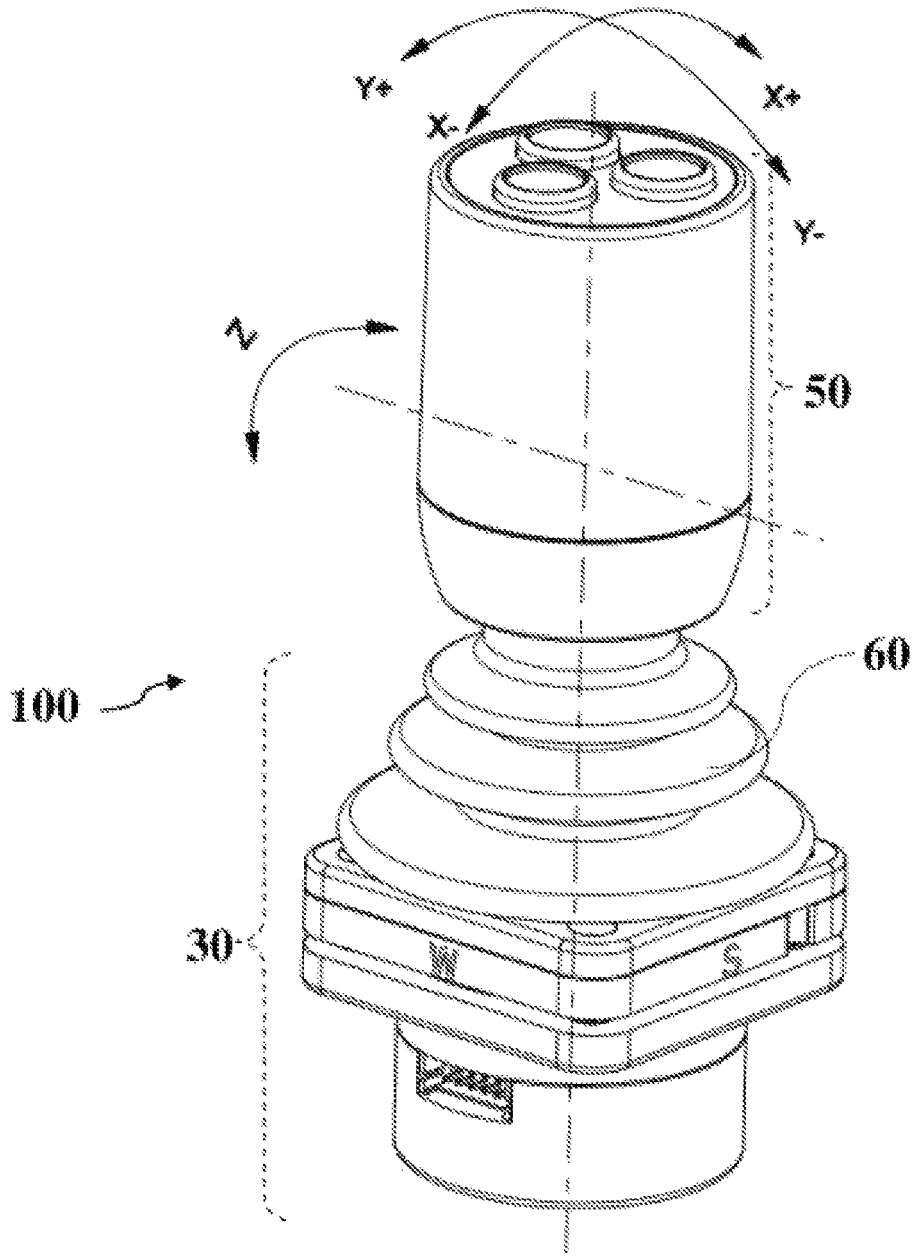
FIG. 3A is a perspective of the joystick according to the present invention.
Figure 3B:
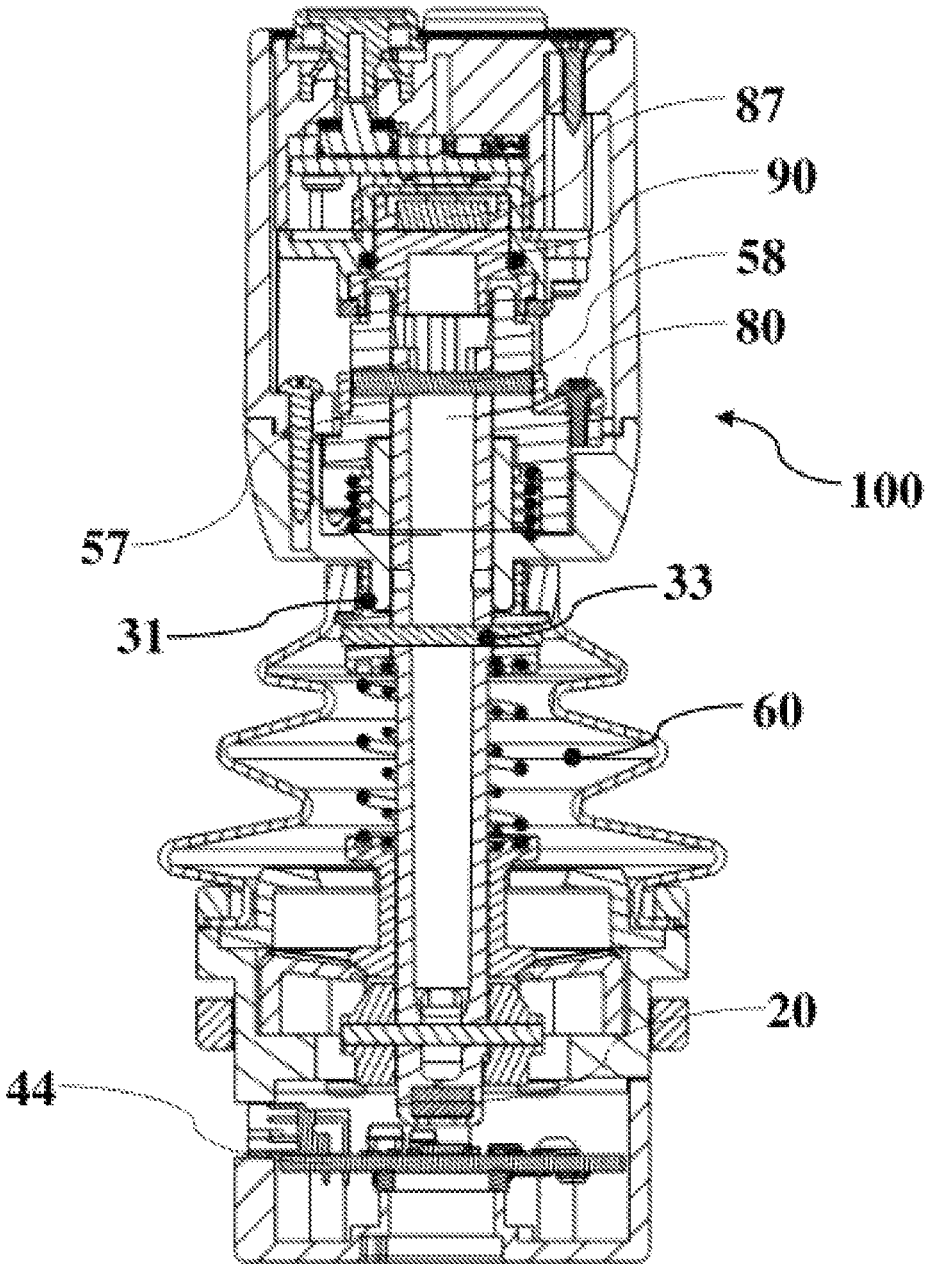
FIG. 3B is a longitudinal cross-sectional view the joystick according to the present invention.
Figure 4:
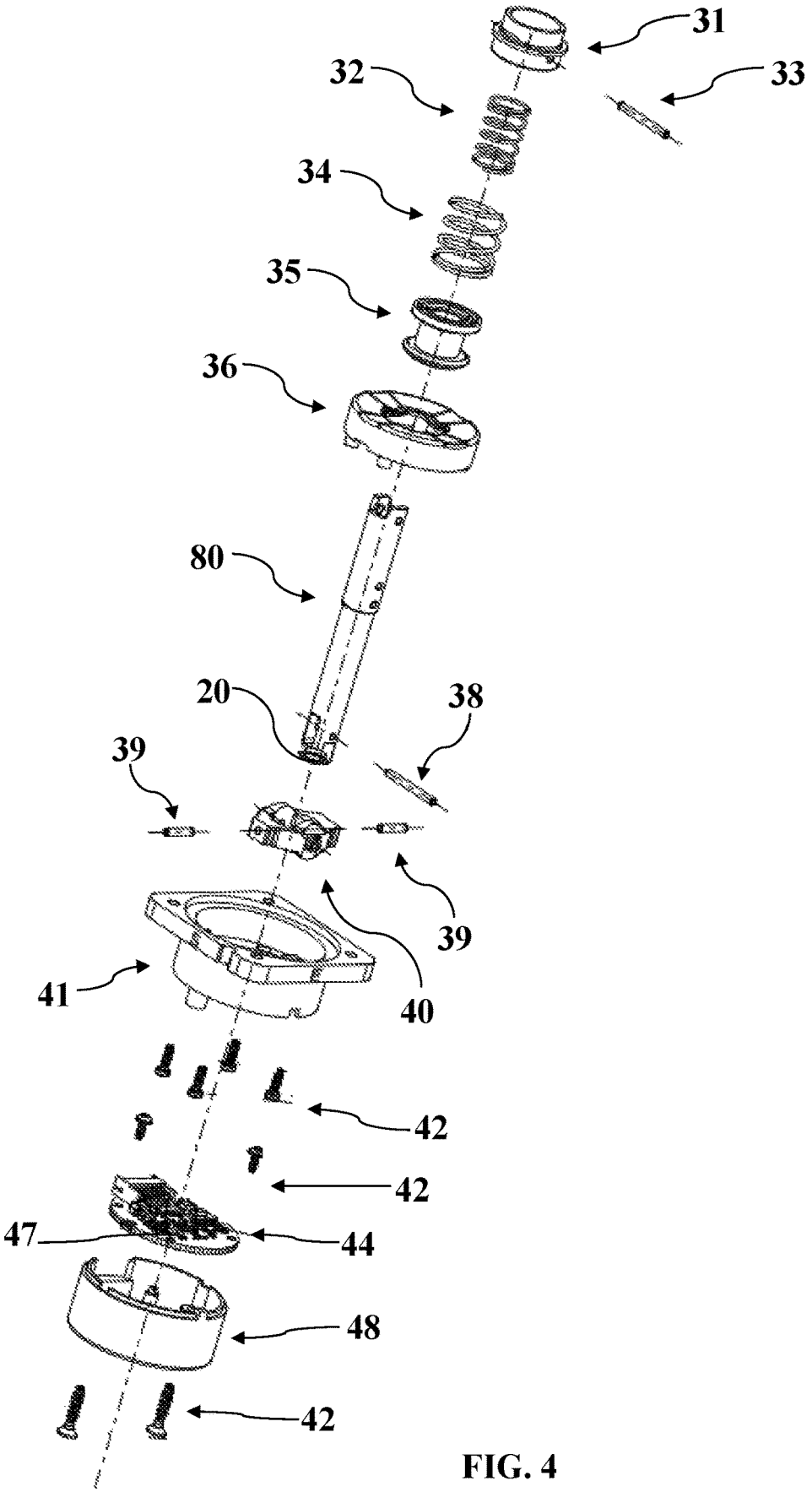
FIG. 4 is an exploded perspective view of a control assembly of the joystick according to the present invention.
Figure 7:
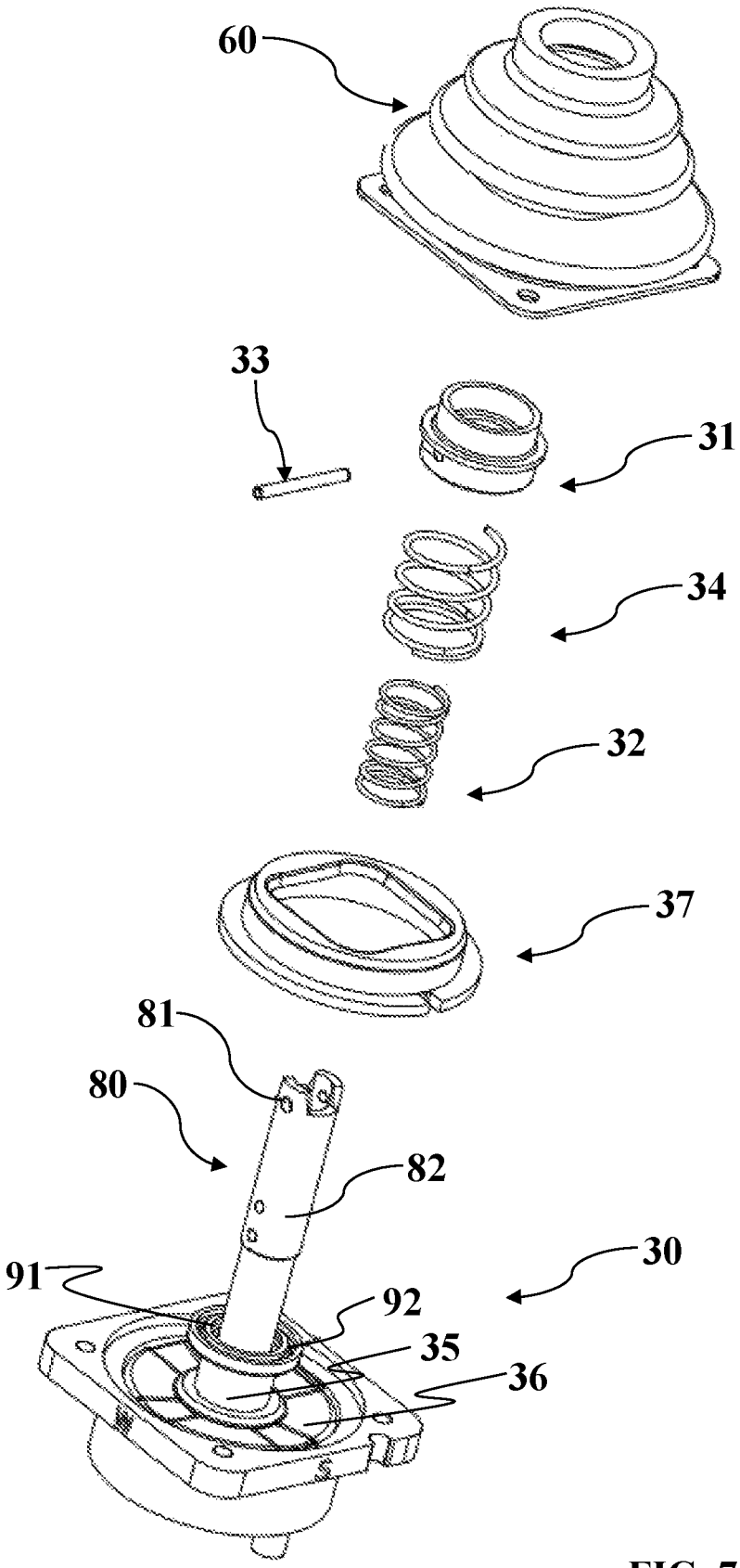
FIG. 7 is another exploded view of the control assembly of the joystick where a control lever is attached to a lower body according to the present invention.

As mentioned above, the control lever (80) is injection molded by using an ejection molding machine with plastic material, and then is assembled with the control assembly (30). Said control lever (80) can have a lower pin hole (84) through which a lower pin (38) is arranged to pass for attaching the control lever (80) to the pivotal member (40), and the upper pin hole (81) through which the upper pin (58) is arranged to pass for attaching the locking member (57) to the control lever (80). Further, said control lever (80) can have a middle pin hole (83) substantially at the middle portion of the control lever (80) for attaching a cap (31) thereof by an intermediate pin (33). Referring to the FIG. 3B, the cap (31) can be placed at the middle portion of the control lever (80) being under the lower handle housing (63). In a preferred embodiment, the joystick (100) has a first spring (32) and a second spring (34) having different diameters with respect to each other, said first and second springs (32, 34) providing an axial biasing action located between the cap (31) and a friction member (35) at the corresponding housings. The friction member (35), which is of generally cylindrical shape having a bore through which the control lever (80) extends, has a first guiding portion (91) in which the first spring (32) is arranged and a second guiding portion (92) in which the second spring (34) is arranged. By using two springs, security and stability of the joystick (100) are enhanced. As shown in FIG. 7, a friction member (35) is provided on the friction plate (36) located on the lower body (41). The friction plate (36) is attached to the inner volume of the lower body (41) to be on the pivotal member (40) and the friction member (35) provided on said friction plate (36) into which said control lever (80) passes. The friction member (35) is biased into contact with the guiding portions (91, 92) by the helical compression springs mounted on the control lever (80) between the friction member (35) and an abutment inner surface of the cap (31).

Figure 15:
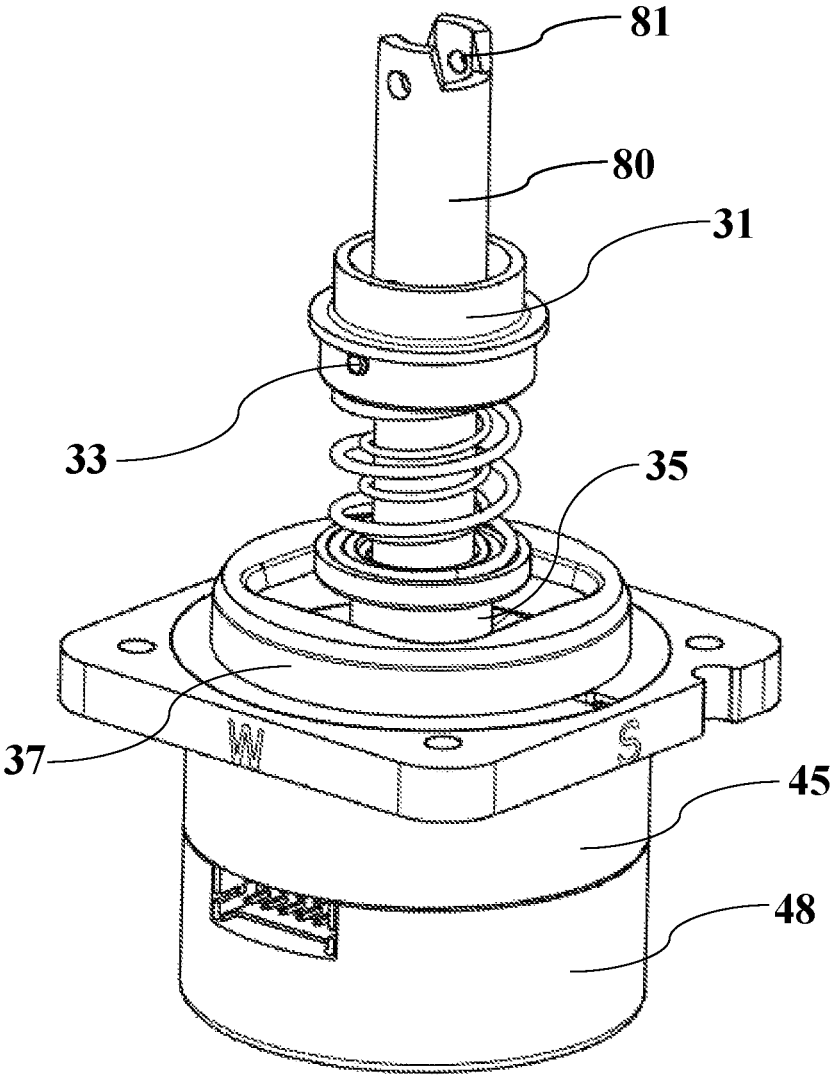
FIG. 15 is another perspective view of the control assembly of the joystick where a flexible boot is removed according to the present invention.

Referring to the FIG. 15, the retention plate (37) having a hollow portion, into which the friction member (35) and the control lever (80) pass, is arranged on the friction plate (36) to limit the movement of the control lever (80) at X and Y axes. Central hollow portion of the retention plate (37) determines the movement angle of the control lever (80) in X and Y directions. When the control lever (80) is moved and so the lower magnet (20), the lower sensor (47) sense the change in X and Y directions and send signals. Said lower circuit (44) preferably has two separate lower sensors (47), each lower (47) is configured to a different axis to sense the movement of the control lever (80) precisely. With this arrangement, the user can get two different signals, if one of the signals does not match with the other then the system may be paused or shutdown which increase the security of the joystick (100).

Figure 12:
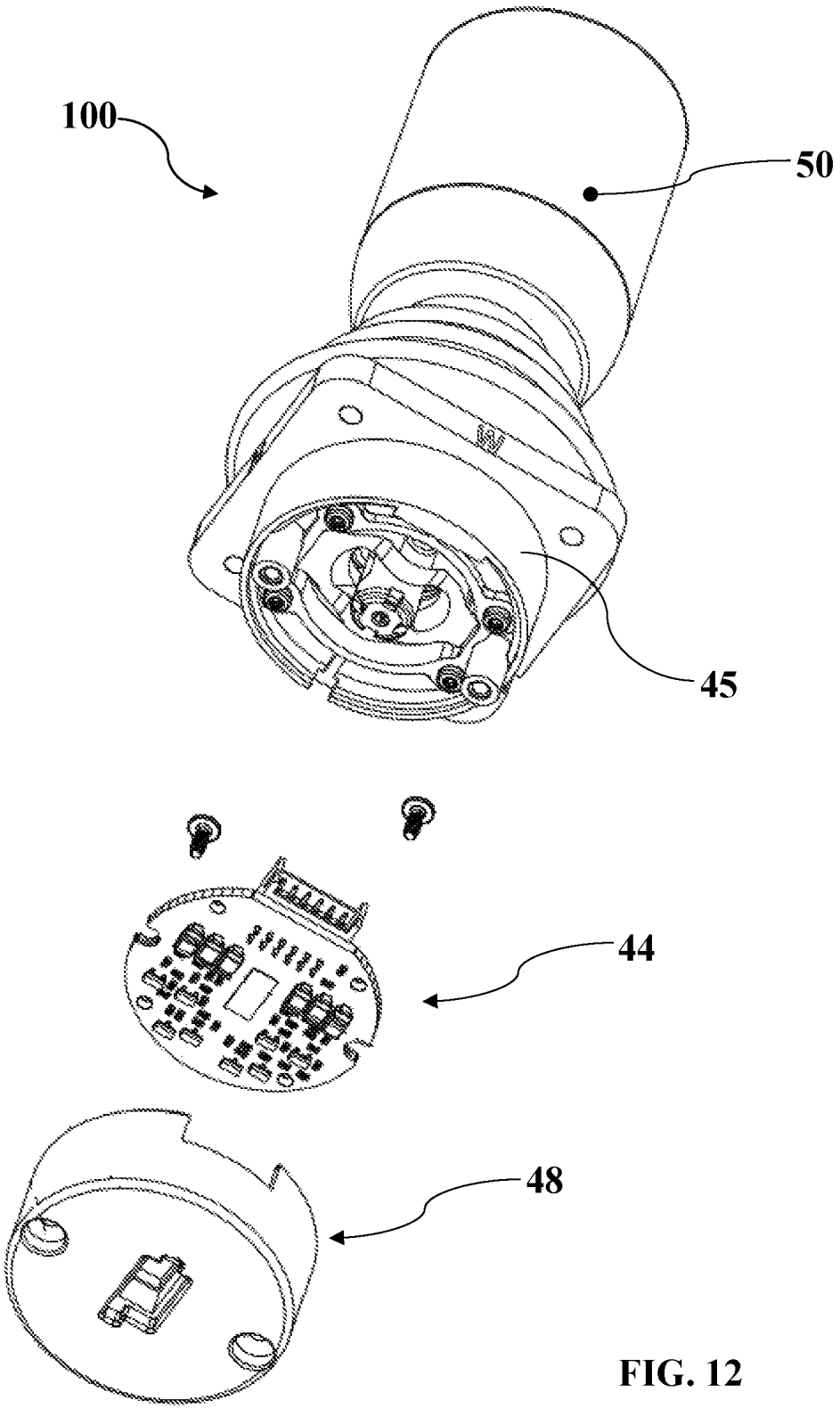
FIG. 12 is a perspective view of the joystick where a lower circuit and a lower cover are removed according to the present invention.

Referring to the FIG. 12, the control assembly (30) has a lower body (41) with a circular hollow skirt (45) extending downwardly in which the lower circuit (44) is placed. A lower cover (48) can be attached to the skirt (45) of the lower body (41) by defining the bottom of the joystick (100). After the lower circuit (44) is placed its housing, the interior volume of the lower body (41) can be filled, at least partly, with an epoxy-based composite wherein said epoxy resin-based composite commonly exhibits excellent strength, toughness, corrosion, moisture and solvent resistance.

Referring to the FIG. 6, the pivotal movement of the control lever (80) is facilitated by means of an arrangement of the pivotal member (40) fixed to the control lever (80) and an inner periphery of the lower body (41). The pivotal member (40) has a part-spherical surface bear against a bearing surface of the lower body (41). The pivotal member (40) is fixed to the control lever (80) by the lower pin (38) which passes through the aligned holes on the control lever (80) and the pivotal member (40). Further, the pivotal member (40) can have two opposite holes into which a pivotal member pin (39) is partly inserted and the rest part of the pivotal member pin (39) is guided on a guiding channel (43). When the control lever (80) is moved so as to pivot about a pivot center defined by the center of the pivotal member (40) when it bears against the bearing surface of the lower body (41). In the production of the control lever (80) by an injection molding, a passage (86) can be formed in the proximity of the end of the control lever (80) such that related connection cables can pass through the passage (86). The control lever (80) is substantially of cylindrical shape so the hollow interior body of the control lever (80) allows the connection cable to be extended through said hollow body and said connection cables exit from the passage (86).

In a preferred embodiment, the upper circuit board (74) is provided with at least one lightning member and the button body (70) is at least partly translucent or transparent. The lightning member can have a series of colors each assigned a different function of the joystick (100) such that the user can be informed by the activity of the joystick (100).

Figure 13:
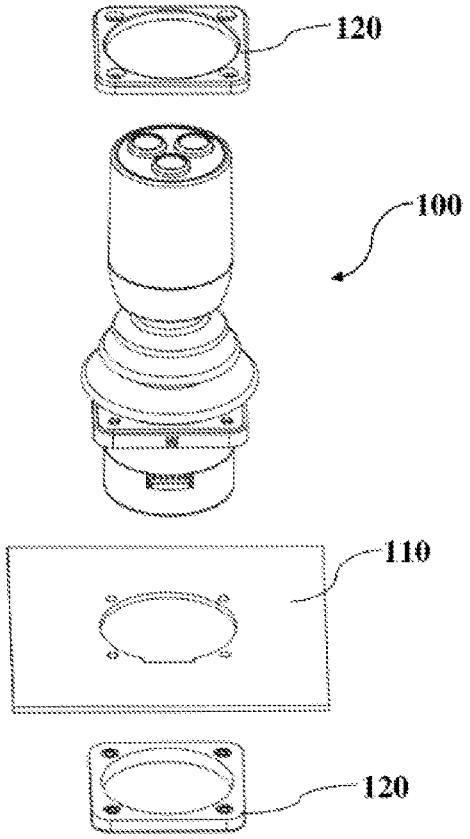
FIG. 13 is a perspective view of the joystick with an attachment plate according to the present invention.
Figure 14:
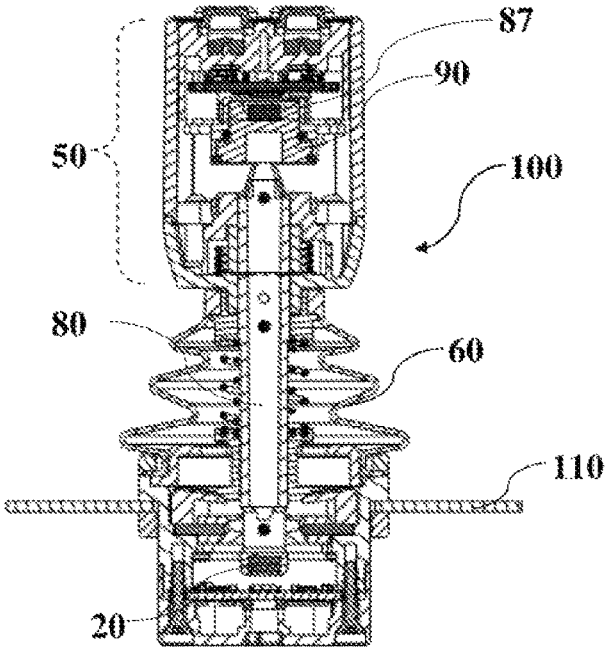
FIG. 14 is a longitudinal cross-sectional view of the joystick shown in FIG. 13.

The control assembly (30) has a flexible boot (60) that surrounds the control lever (80) and pivotal movement mechanism so as to protect the components from ingress of materials such as grits that could damage the components. The flexible boot (60) can be made of plastic material and have a series of corrugated portions. The flexible boot (60) is provided mainly between the spring house (63) and the lower body (41). The joystick (100) is used with a plurality of fastening members (42). Referring to the FIG. 13, the joystick (100) can be attached to an attachment plate (110) by using two separate attachment member (120) placing on and underneath the attachment plate (110). Said circuit boards are generally printed circuit boards.

What is claimed is:

1. A joystick for controlling a machine in multi-axes, comprising:

a handle assembly allowed to rotate around a central axis extending along a longitudinal direction of the joystick, wherein the handle assembly comprises a button body, and an upper circuit having an upper sensor is provided in the button body;

a control assembly having a lower body, wherein a lower circuit with a lower sensor is provided in the lower body; and a control lever partly introduced to the handle assembly and mounted on a pivotal member for a pivotal movement relative to the lower body, wherein the control lever is at least partly made of plastic in an injection-molding operation and has an overmolded lower magnet provided in a proximity of the lower circuit of the control assembly, wherein the control lever has an upper magnet provided in a proximity of the upper circuit of the handle assembly; and the control lever has a separate upper lever part having the upper magnet, and the separate upper lever part is formed as an extension of the control lever in the handle assembly.

2. The joystick according to claim 1, wherein the handle assembly has a locking member having at least one connection protrusion arranged to match with a corresponding housing of the upper lever part, wherein the locking member is attached to the control lever.

3. The joystick according to claim 2, wherein the upper lever part is placed within an upper magnet housing facing the upper circuit of the handle assembly.

4. The joystick according to claim 3, wherein the control lever has a lower pin hole and an upper pin hole, wherein a lower pin is arranged to pass through the lower pin hole for attaching the control lever to the pivotal member, and an upper pin is arranged to pass through the upper pin hole for attaching the locking member to the control lever.

5. The joystick according to claim 3, wherein the button body has at least one button hole and each of the at least one button hole is provided with a button and a button spring associated with a button switch provided on the upper circuit, wherein the button and the button switch have a sealing member provided between the button and the button switch to provide sealing.

6. The joystick according to claim 2, wherein the control lever has a lower pin hole and an upper pin hole, wherein a lower pin is arranged to pass through the lower pin hole for attaching the control lever to the pivotal member, and an upper pin is arranged to pass through the upper pin hole for attaching the locking member to the control lever.

7. The joystick according to claim 6, wherein the button body has at least one button hole and each of the at least one button hole is provided with a button and a button spring associated with a button switch provided on the upper circuit, wherein the button and the button switch have a sealing member provided between the button and the button switch to provide sealing.

8. The joystick according to claim 2, wherein the button body has at least one button hole and each of the at least one button hole is provided with a button and a button spring associated with a button switch provided on the upper circuit, wherein the button and the button switch have a sealing member provided between the button and the button switch to provide sealing.

9. The joystick according to claim 2, wherein the joystick comprises a friction plate and a friction member, wherein the friction plate is attached to an inner volume of the lower body to be on the pivotal member, and the friction member is provided on the friction plate, wherein the control lever passes in the friction member.

10. The joystick according to claim 1, wherein the button body has at least one button hole and each of the at least one button hole is provided with a button and a button spring associated with a button switch provided on the upper circuit, wherein the button and the button switch have a sealing member provided between the button and the button switch to provide sealing.

11. The joystick according to claim 1, wherein the joystick comprises a friction plate and a friction member, wherein the friction plate is attached to an inner volume of the lower body to be on the pivotal member, and the friction member is provided on the friction plate, wherein the control lever passes in the friction member.

12. The joystick according to claim 11, wherein the joystick comprises a cap having connection holes, wherein an intermediate pin passes through the connection holes via a medium pin hole for attaching the cap.

13. The joystick according to claim 12, wherein the joystick comprises a first spring and a second spring having different diameters with respect to each other, wherein the first spring and second spring provides an axial biasing action located between the cap and the friction member.

14. The joystick according to claim 13, wherein the friction member has a first guiding portion and a second guiding portion, wherein the first spring is arranged in the first guiding portion, and the second spring is arranged in the second guiding portion.

15. The joystick according to claim 1, wherein the button body is at least partly filled with an epoxy-based composite (93) for sealing.

16. The joystick according to claim 1, wherein the upper circuit is provided with at least one lightning member, and the button body is at least partly translucent or transparent.

17. The joystick according to claim 1, wherein the control lever is made of plastic in the injection-molding operation and the overmolded lower magnet is completely embedded in the control lever.

18. The joystick according to claim 1, wherein the separate upper lever part is made of plastic in the injection-molding operation and the upper magnet is completely embedded in the separate upper lever part.

19. The joystick according to claim 1, wherein each of the lower circuit and the upper circuit has a lower sensor and an upper sensor, respectively; each of the lower sensor and the upper sensor is configured to sense a displacement of the overmolded lower magnet and the upper magnet, wherein each of the lower sensor and the upper sensor is a Hall-effect sensor.

* * * * *